US005568129A

United States Patent [19]

Sisselman et al.

[11] Patent Number: 5,568,129

[45] Date of Patent: Oct. 22, 1996

[54] ALARM DEVICE INCLUDING A SELF-TEST REMINDER CIRCUIT

[76] Inventors: Ronald Sisselman, 13 Cedar Gate Cir., Aurora, Ill. 60506; Gerald D. Rork, 924 Willow La., Sleepy Hollow, Ill. 60118

[21] Appl. No.: 302,634

[22] Filed: Sep. 8, 1994

[51] Int. Cl.[6] ..... G08B 17/10

[52] U.S. Cl. ..... 340/628; 340/309.15; 340/514; 340/515; 340/516

[58] Field of Search ..... 340/628, 629, 340/630, 309.15, 514, 515, 516

[56] References Cited

U.S. PATENT DOCUMENTS

| | | | |
|---|---|---|---|
| 4,097,850 | 6/1978 | Conforti | 340/514 |
| 4,138,670 | 2/1979 | Schneider | 340/507 |
| 4,148,019 | 4/1979 | Durkee | 340/531 |
| 4,595,914 | 6/1986 | Siegel | 340/515 |
| 4,827,244 | 5/1989 | Bellavia et al. | 340/514 |
| 4,965,556 | 10/1990 | Brodecki et al. | 340/628 |

*Primary Examiner*—Jeffery Hofsass
*Assistant Examiner*—Julie B. Lieu
*Attorney, Agent, or Firm*—Woodard, Emhardt, Naughton, Moriarty & McNett

[57] ABSTRACT

A smoke alarm device including self-test reminder circuitry is provided. The smoke alarm includes smoke detection circuitry and a smoke sensor, the functionality of which may be tested using a test switch connected in parallel across the smoke sensor. Additionally, a reminder circuit is provided, the output of which may be used to enable an indicator. The indicator may be the horn or annunciator of the smoke detector, or may be some other type of indicator, such as a light or other audible indicator. Periodically, the reminder circuit will cause the indicator to become enabled so as to remind the consumer to test the smoke alarm. The indicator will remain enabled until the reminder circuit is manually reset by the consumer. Actuation of the test switch simultaneously tests the functionality of the smoke detection circuitry and resets the reminder circuit.

31 Claims, 9 Drawing Sheets

ALARM DEVICE INCLUDING A SELF-TEST REMINDER CIRCUIT

BACKGROUND OF THE INVENTION

1. Field of the Invention

The present invention relates to an alarm device which includes a self-test reminder circuit provided to periodically remind a consumer to test the functionality of the alarm device. More specifically, in connection with the present invention a smoke alarm device (i.e. a combustion products detector, fire alarm, smoke detector etc.) is provided including the above-described reminder circuitry.

2. Description of the Prior Art

Presently, many types of electronic combustion detection devices, such as smoke alarms, provide a consumer with the means to manually test the operation of the device. For example, conventional model smoke alarms are provided with an external test switch used to simulate a voltage present at an electrode in the smoke sensor in the presence of smoke, thus testing the functionality of the smoke alarm. There is evidence that some smoke alarm owners never test their smoke detectors or alarms, while others do not test at the recommended intervals. The National Fire Protection Association recommends testing battery operated smoke alarms weekly and AC mains powered smoke alarms monthly.

In U.S. Pat. No. 4,827,244 to Bellavia et al., incorporated by reference herein, it is recognized that merely providing a "push to test" function in an alarm device, is no assurance that it will in fact be used. In the '244 patent there is provided a more convenient means for testing a smoke alarm using radiant energy, rather than forcing a consumer to climb on a chair or ladder, or to need other special equipment to test the alarm. It is one object of the invention '244 patent to overcome the inconvenience of attempting to initiate a test or other secondary function when the unit is remotely located on a ceiling or high wall. However, the invention of the '244 patent will not periodically remind the user to manually test the unit.

Even if the means for testing the smoke alarm were easy and convenient, many consumers will still find it inconvenient to periodically test their smoke alarm devices. As a result, those consumers will not test their alarms. Other consumers forget to test their smoke alarms, or put off testing them for long periods of time. Still others never test their alarms, nor even realize that they should.

U.S. Pat. No. 4,595,914 to Siegel, additionally incorporated by reference herein, teaches a self-testing combustion products detector which includes means for automatically periodically testing the sensitivity of the sensor. One problem with an automatically self-testing smoke detector is that the consumer may come to rely on the automatic self-test feature, and thus, be lulled into not testing the smoke alarm manually. Thus, if the automatic self test circuit fails the consumer is left with the false impression that the smoke alarm is being tested and is functional, when this may not be the case.

Additionally, there is currently made a smoke alarm including automatic self-test circuit that periodically tests itself, and sounds an annunciator or horn once at a given time if the smoke detection circuitry is functional. However, one disadvantage of that smoke alarm is that a person need be physically present at exactly the right time to hear the horn, and additionally, need be aware that if the horn does not sound, that there is a problem with the smoke alarm.

Further, it may be desirable for a person to visually inspect the condition, and personally test the functionality of the smoke alarm, including the hom. The use of self-testing smoke alarms lull people into forgetting entirely about testing their smoke alarms, and thus do not accomplish these objectives. None of the above-mentioned smoke alarms ensure that an actual person periodically tests the smoke alarm functionality at predetermined intervals, Nor do they prompt or remind a person when to manually test the smoke alarm.

Further, it may be desirable to have an actual person physically present when the smoke alarm is tested so as to familiarize that person with the sound made by the smoke alarm under alarm conditions. A person thus familiarized will be better able to recognize and associate the horn sound with the smoke alarm at a later, unexpected time. If a person is forced to periodically test the smoke alarm device, that person will be better able to make an association between the sound of the horn and the smoke alarm when, for example, the person is awakened from a sound sleep by the sounding of the smoke alarm. None of the above-mentioned devices periodically encourage the user to physically test the smoke alarm, thus familiarizing the user with the smoke condition indication of the smoke alarm.

What is needed is a smoke detector that periodically prompts a consumer to manually test be functionality of a smoke alarm. Further, there is a need for a smoke detector which periodically encourages a user to visually inspect the condition of the smoke alarm, as well as forces the user to become familiarized with the sound or alternate smoke condition indicator of the smoke alarm under smoke conditions.

SUMMARY OF THE INVENTION

In accordance with the present invention, a smoke alarm device is provided, wherein the smoke alarm device comprises smoke alarm circuitry, a test switch for actuation by a user for testing the smoke alarm circuitry, an indicator, and a reminder circuit for turning on the indicator to remind the user to test the smoke alarm circuitry, wherein the user may reset the reminder circuit by actuating the test switch.

One object of the present invention is to provide a reminder to a consumer to manually test a smoke alarm.

Another object of the present invention is to provide an improved smoke alarm device, including built-in reminder circuitry.

Another object of the present invention is to provide an improved smoke alarm device which encourages the user to periodically test and inspect the condition of the device, while familiarizing the user with the indicator used by the device under alarm conditions.

Further objects and advantages of the present invention will become apparent from the description of the preferred embodiments which follow.

DESCRIPTION OF THE PREFERRED EMBODIMENT

Figure 1:
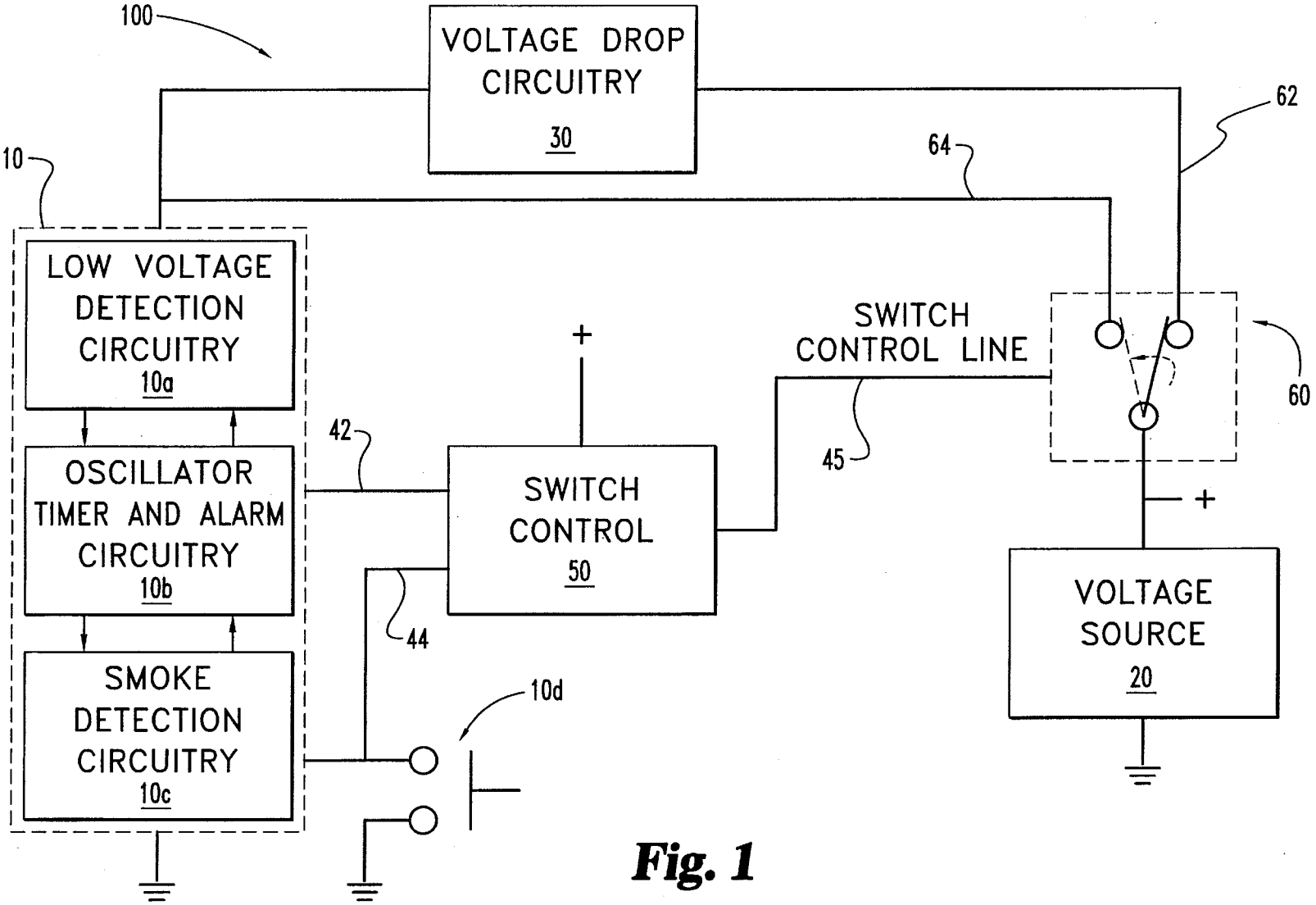
FIG. 1 is a block diagram showing one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In the present invention, there is provided an alarm device including self-test reminder circuitry to remind a consumer or user to manually test the functionality of a smoke alarm. At present, smoke alarms are provided with a normally open self-test switch. The self-test switch may be manually operated to test that the sensitivity of the smoke sensor is above a predetermined minimum sensitivity in a well known manner, as is described in greater detail in U.S. Pat. Nos. 4,097,850 and 4,595,914, those patents incorporated herein by reference.

As used herein, a test switch or self-test switch is described herein, it is contemplated that that test switch may be a mechanical switch, an electrical switch (such as a phototransistor, as taught the '244 patent), a magnetic switch or some other kind of switch means for use in a smoke alarm device. Further, when it is stated that the self-test switch or reset switch may be manually actuated, or that the alarm device may be manually tested, those terms are meant to encompass, for example, a mechanical actuation of a "push to test" type test switch by a consumer or the actuation of the test switch using a continuous or pulsed input, as described in U.S. Pat. No. 4,827,244, previously incorporated herein. Other means of manually testing a smoke alarm device are known in the art and are intended to be encompassed herein.

Referring now to FIG. 1, there is shown a block diagram of a first preferred embodiment of the present invention. Alarm device 100 includes a smoke alarm unit 10, comprising low voltage detection circuitry 10*a*, oscillator timer and alarm circuitry 10*b* and smoke detection circuitry 10*c*, as well as test switch 10*d*. The smoke alarm unit 10 of the present invention may be of a known type of smoke alarm unit, such as is taught in the '244 patent, previously incorporated by reference herein. These known smoke alarm units normally include many of the smoke alarm components integrated into a single integrated circuit, such as the MC14466, MC14467-1 or the MC14468, all made by Motorola, as will be described further in connection with FIGS. 3 and 9.

Smoke alarm unit 10 is powered by a power or voltage source 20. The voltage source 20 of the present invention may be of any type of known power source for a smoke alarm. Some examples of known types of power sources are shown and described in connection with FIGS. 8A–C. At present, it is common for battery powered alarm devices or some AC powered alarm devices which include a battery backup to also include low voltage detection circuitry 10*a*. Such low voltage detection circuitry may be used in any smoke alarm of the present embodiment, which did not already include it (i.e. a purely AC powered unit).

Figure 8A:
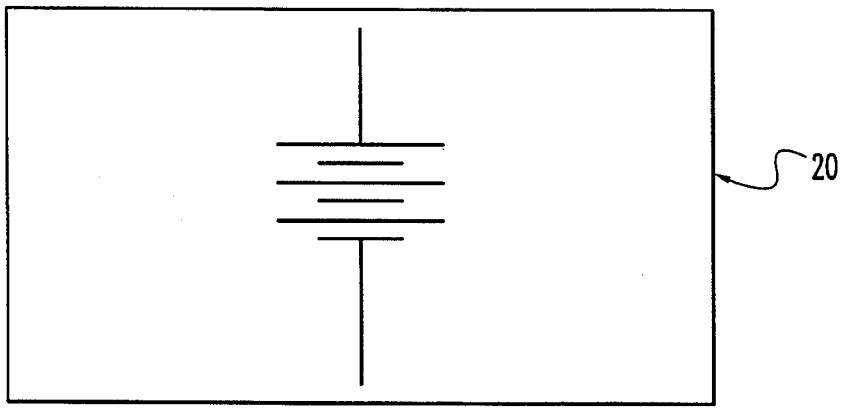
FIGS. 8A–C show examples of power sources which may be used with various embodiments of the present invention.
Figure 8B:
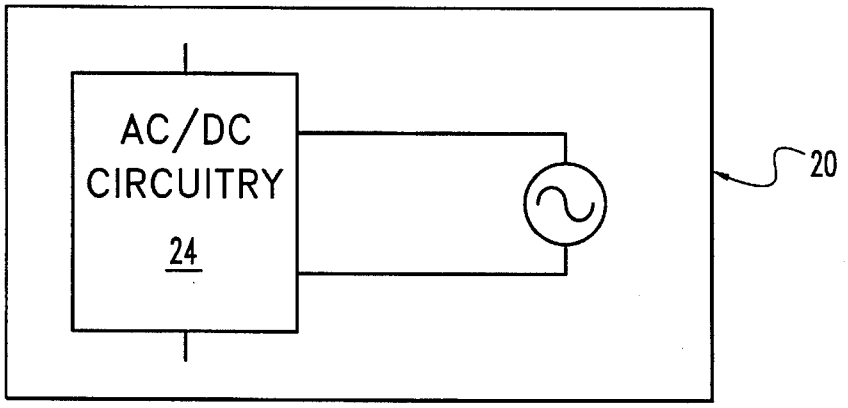
Figure 8C:
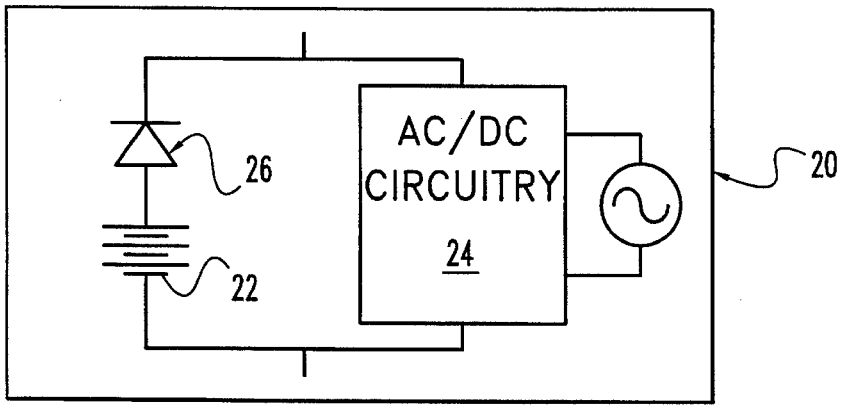

In ordinary operation, the smoke alarm unit 10, when powered by a voltage source 20, will operate to indicate the presence of smoke, using the smoke detection circuitry 10*c*. in combination with the oscillator timer and alarm circuitry 10*b*. Voltage source 20 may be chosen from known power sources, some examples of which are a DC power source such as the battery of FIG. 8A, an AC power source converted to DC as shown in FIG. 8B, or an AC source with DC power backup, as shown in FIG. 8C. Additionally, smoke alarm unit 10 will operate to indicate when the voltage of the source powering the smoke alarm Unit 10 has dropped below a predetermined voltage level.

The reminder circuitry of the present embodiment utilizes the on-board low voltage detection circuitry 10*a* to remind a consumer to manually test the alarm device 100. In this first preferred embodiment, the reminder circuitry includes the switch control 50, the voltage drop circuitry 30 and switch 60. Switch 60 may be any kind of switch known in the art, such sis an electrical or an electro-mechanical switch (i.e. an electrically thrown single-poles/double-throw switch), etc. In one particular preferred embodiment, shown in FIG. 2, a transistor switch 160 is used.

Referring back to FIG. 1, the switch 60 is connected so as to provide a voltage at the smoke alarm unit 10 via one of two different circuit paths. If switch 60 connects the voltage source 20 to the smoke alarm unit 10 via conductor 64, then substantially the full voltage of the voltage source 10 is provided to the smoke alarm unit 10. If the switch 60 connects the voltage source 20 to the smoke alarm unit 10 via conductor 62, then the voltage appearing at the smoke alarm unit 10 is reduced by a voltage drop due to the serially connected voltage drop circuitry 30.

The voltage drop circuitry 30 operates to supply a voltage below a predetermined minute in voltage level to the smoke alarm unit 10, and thus to the low voltage detection circuitry 10*a* contained therein. The voltage drop of voltage drop circuitry 30 is particularly chosen so as to ensure that when switch 60 connects the voltage source 20 to the smoke alarm unit 10 via the path including the voltage drop circuitry 30, the reduced voltage will cause the circuitry of smoke alarm unit 10 to sound a low voltage warning alarm or 'chirp'. Thus, when the switch is thrown, the smoke alarm unit 10 will periodically emit an audible warning 'chirp' to remind the consumer to manually test the smoke alarm unit 10, using self-test switch 10*d*. In conventional smoke alarms and as defined herein, this 'chirp' is emitted for 10 ms, about once every 40–48 seconds. Further, the operation of switch 60 is controlled by the switch control 50, via switch control line 45.

In the present embodiment, as can be seen from the above explanation, the reminder circuitry 'chirp' will be identical to the low voltage warning 'chirp' normally sounded by battery powered detectors when a low battery voltage is detected. A consumer, upon hearing the persistently recurring 'chirp', will be instructed via the alarm device instructional manual, to first manually test the smoke detector, wherein the horn will sound continuously for a period of time depending on the length of time the unit is manually tested. If the 'chirp' reoccurs within minutes after the manual test has been completed, the consumer is instructed to replace the battery.

Figure 4:
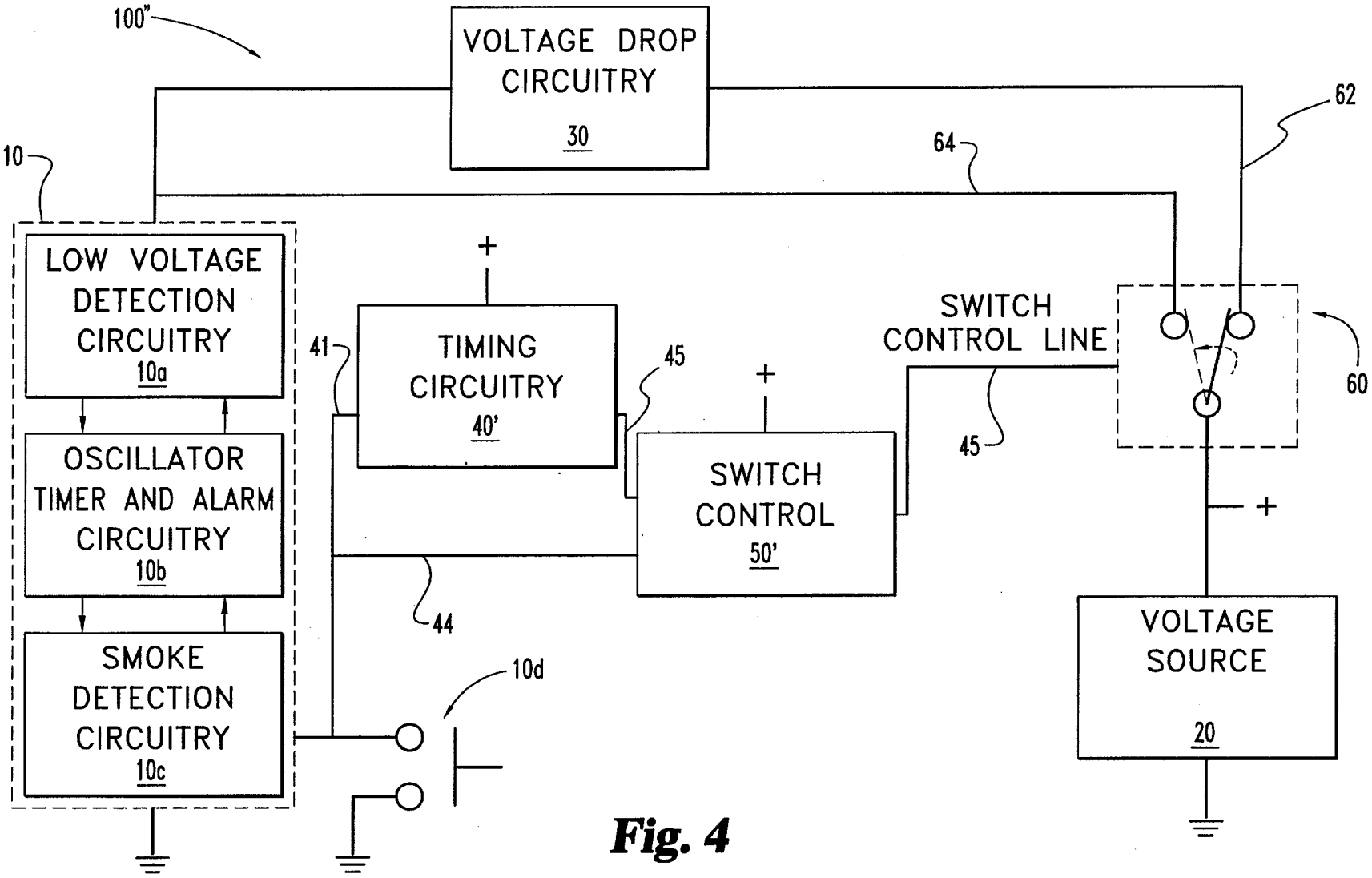
FIG. 4 is a block diagram of another embodiment of the present invention.

The alarm device 100 of FIG. 1 operates as follows. Initially, the switch 60 is operating to provide substantially the full voltage from voltage source 20 to the smoke alarm unit 10. Switch control 50 obtains a timing signal from the oscillator timer and alarm circuitry 10*b*, via conductor 42. The internal oscillator of many smoke detector IC's operates with a period of 1.67 seconds during no-smoke conditions and 40 ms under smoke conditions. The switch control 50 may make use of this oscillator signal directly or may use the oscillator pulse used every 24 cycles (40.08 seconds) to test the voltage source using the low voltage detection circuitry. Alternatively, an external timing circuit as shown in FIG. 4, may be used to determine when it is time to alert the consumer to test the alarm device 100. The timing of the oscillator timer circuitry may be altered from the above values and still remain within the teachings and spirit of the present invention.

At some point in time, which is set in the switch control circuitry 50, the switch control 50 will send a signal to the switch 60 to cause the switch 60 to connect the reduced voltage (voltage source—voltage drop of voltage drop circuitry 30) circuit path to the smoke alarm unit 10, via conductor 62. Thus, the presence of the reduced voltage will be detected by the low voltage detection circuitry 10*a* and the alarm circuitry portion of the oscillator timer and alarm circuitry 10*b* will cause an indicator to alert the consumer of the low battery detection. Typically a piezo-electric horn (although other types of annunciators and indicators may be used) will emit a 10 ms horn 'chirp' about once every 40–48 seconds. The alarm device 100 will continue to 'chirp' until the switch control 50 is reset by a consumer. To reset the switch control 50, the consumer manually actuates the test switch 10*d*, which simultaneously results in the testing of the smoke detection circuitry 10*c* of the smoke alarm unit 10. Thus, the warning 'chirp' of the present embodiment prompts the consumer to manually actuate the test switch to stop the warning chirp, and thus incidentally and purposefully causes the consumer to test the smoke detector.

Figure 2:
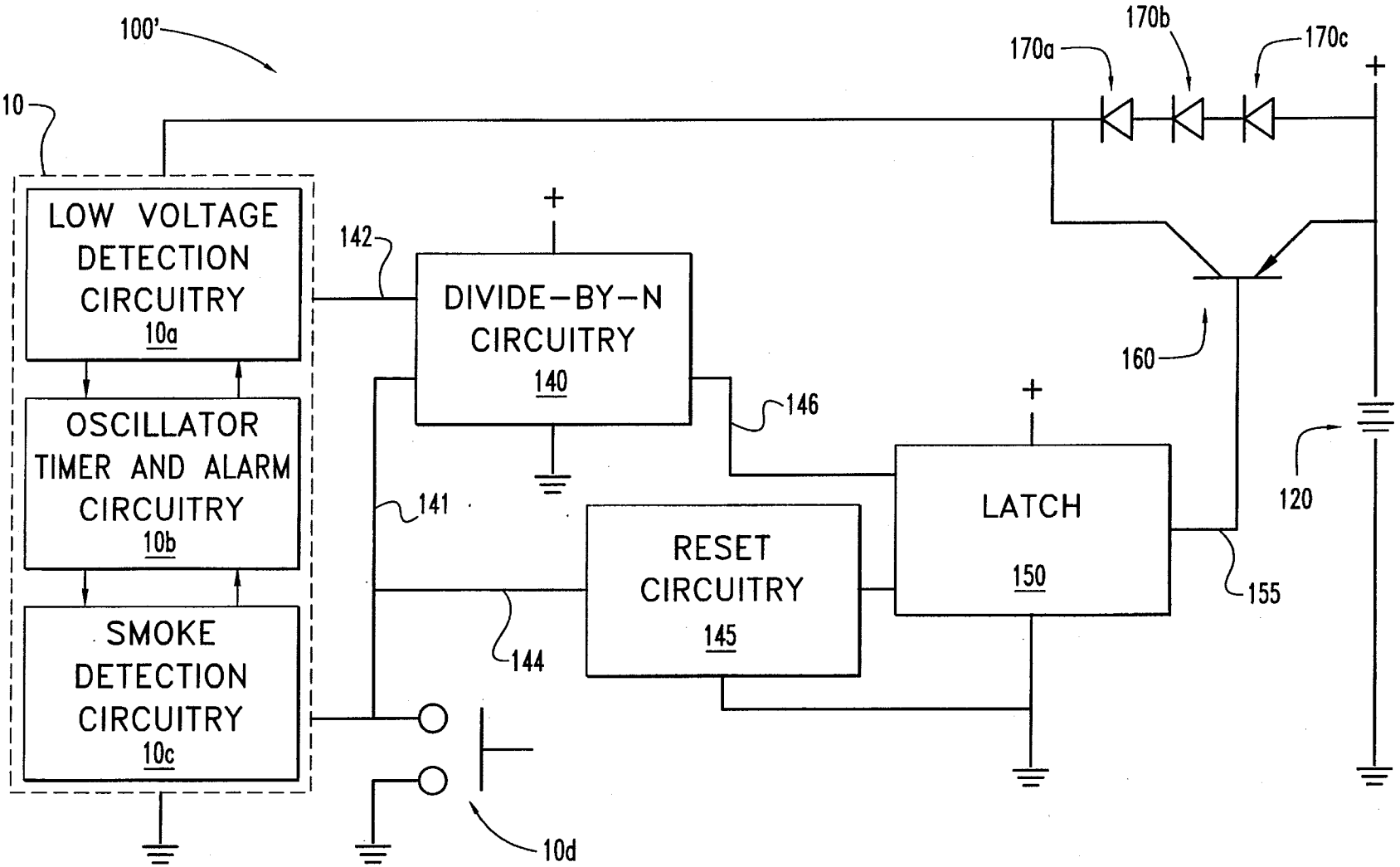
FIG. 2 is a block diagram of one particular implementation of the embodiment of FIG. 1.

Referring now to FIG. 2 there is shown a block diagram of one particular implementation of the alarm device 100 of FIG. 1. As with the embodiment of FIG. 1, the alarm device 100' of FIG. 2 includes a smoke alarm unit 10, which includes low voltage detection circuitry 10*a*, oscillator timer and alarm circuitry 10*b* and smoke detection circuitry 10*c*, as well as test switch 10*d*. The operation of smoke alarm unit 10 may be the same as described above in connection with the smoke alarm unit 10 of FIG. 1. Alarm device 100' additionally includes a voltage source, namely battery 120. In the present preferred embodiment shown in FIG. 2, the battery 120 is designed to initially supply 9 DC Volts +/−1 volt when it is at its maximum voltage level. As described above, although a battery is shown in FIG. 2, the voltage source of any of the embodiments of the present invention may be chosen from among the group of common smoke detector power source types, examples of which are shown in FIGS. 8A–8C.

As shown in FIG. 2, the emitter of a pnp transistor switch 160 is connected to the positive terminal of the battery 120. The base of the transistor switch 160 is connected to the output of a flip-flop or latch circuit 150 via a base resistor (not shown).

Additionally, three diodes (170*a–c*), representing a diode drop of about 2.1 volts, may be connected in series with each other and in parallel between the emitter and the collector of the transistor switch 160. The use of three diodes is not meant to be limiting as other sources of a voltage drop may be used, for example, diode and/or resistor combinations may be used. Likewise, it can be seen from the teachings how the circuit may be modified to use another type of transistor (i.e. npn, MOSFET, JFET, etc.).

When the input to the base of the pnp transistor switch 160 is low, the transistor is conducting and the voltage at the collector (and thus, at the smoke alarm unit 10) is substantially the full voltage of the battery 120. If the input to the base of the transistor switch 160 is high, the transistor switch 160 is turned off, and the voltage at the smoke alarm unit 10 is the voltage of the battery 120, less the voltage drops across the diodes 170*a–c*. Diodes 170*a–c* are chosen so as to reduce the voltage to the smoke alarm unit 10 sufficiently to cause a low voltage indication by the low voltage detection circuitry 10*a*. Thus, greater or fewer numbers of diodes and/or resistors may be used depending on the source Voltage and the low voltage reference threshold of the low voltage circuitry 10*a*.

Divide-by-n counter circuitry 140 is connected to the smoke alarm unit 10 to receive a timing or clock signal from that circuitry, as defined herein. Ideally, the National Fire Protection Association recommends testing battery operated smoke alarms weekly and AC powered smoke alarms monthly. As such, for a weekly reminder, if the 1.67 second no-smoke oscillator signal is used, the divide-by-n number (n) would be 362,156. Likewise for a weekly reminder, if the low battery comparator (or low voltage comparator) signal, which occurs once every 24 oscillator cycles or about every 40–48 seconds, Were used, the divide-by-n number (n) would be 15.120. For approximately monthly testing, the divide by numbers are multiplied by four. Further, a single divide-by-n counter chip could be used or multiple divide-by-n counter devices could be cascaded together to obtain the desired divide-by-n circuitry.

The divide-by-n counter circuitry 140 will provide an output to the latch 150, via conductor 146, after n timing signals have been counted or received by the divide-by-n counter circuitry. Initially, the output of the latch is set low. When the latch receives a signal from the divide by-n counter circuitry, via conductor 146, the output of the latch 150 goes high and the transistor switch 160 is turned off. The output of the latch 150 will remain high until the latch is reset. As stated above, turning off transistor switch 160 results in a reduced voltage being provided to the smoke alarm unit 10 and results in a low voltage warning 'chirp'.

Alternatively, if a counter is chosen which maintains a high output after the desired count has been reached, the latch 150 may be omitted, and the output of the counter may be directly connected to the base of the transistor 160. Thus, the latch 150 may be eliminated.

A consumer may discontinue the warning or reminder 'chirp' by manually testing the smoke detection circuitry 10*c*. using the test switch 10*d*, which simultaneously tests the smoke detection circuitry, resets the latch via reset line 144 and reset circuit 145, and, optionally, resets the divide-by-n counter circuitry to n=0. The reset line 141 to the divide-by-n counter circuitry 140 is provided as a convenience to the consumer, as the consumer, knowing they may be away when the reminder circuit will finish its count and set the latch, may preemptively test the alarm device 100', thus resetting the divide-by-n counter to zero and restarting the time until the next reminder warning. Additionally, the reset line 141 may be connected between the reset circuit 145 and the divide-by-n counter circuitry 140, if needed. Latch 150, divide-by-n counter circuitry 140, and reset circuitry 145 are all powered by the voltage source, battery 120, and all have connections to ground.

Figure 3:
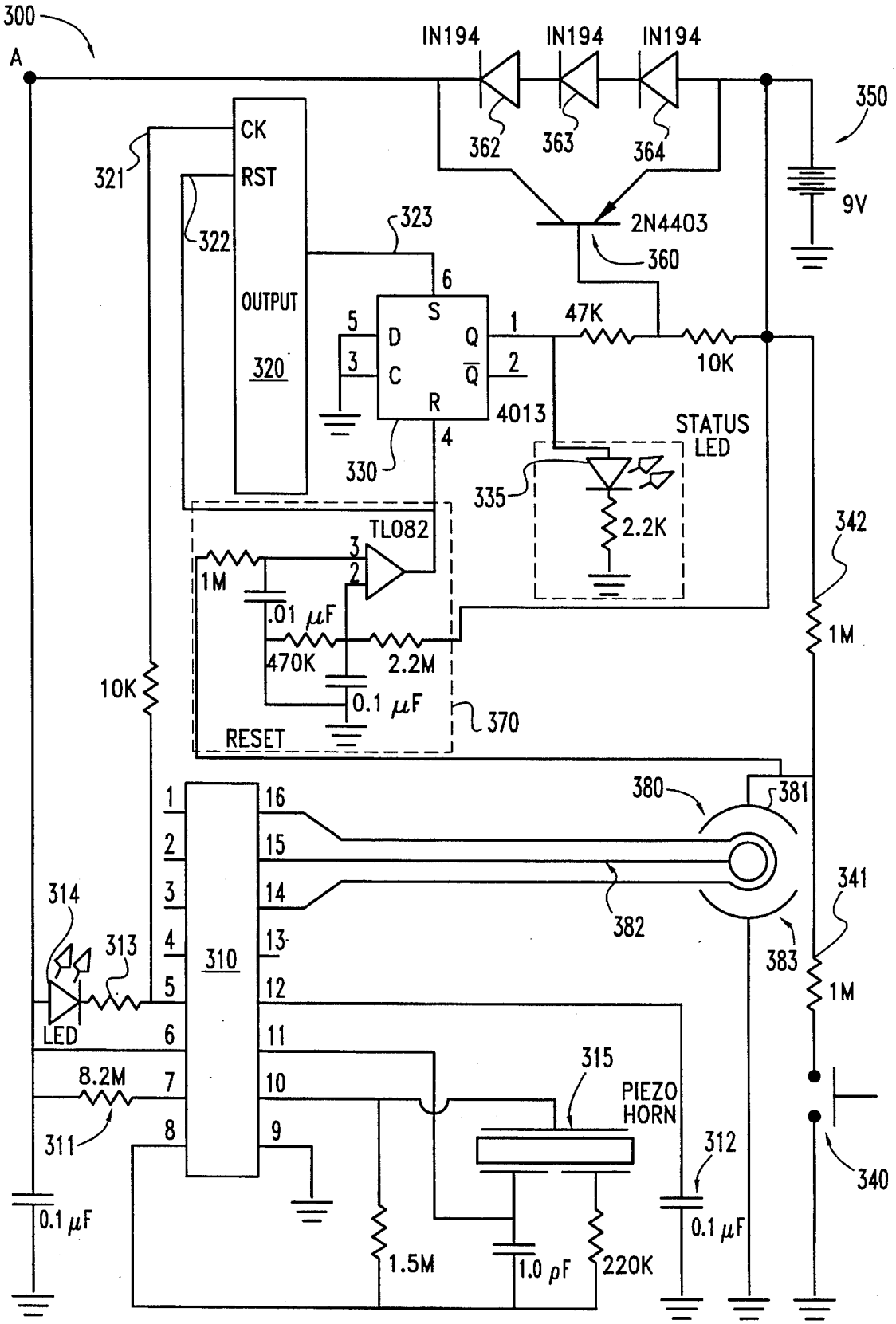
FIG. 3 is a schematic diagram showing one particular implementation of the embodiment of FIG. 2.

In FIG. 3, there is shown a schematic diagram of an alarm device 300 in accordance with one particular embodiment of the present invention. Many of the components shown in connection with the low voltage detection circuitry, oscillator timer and alarm circuitry, and the smoke detection circuitry of FIGS. 1–2 and 4–7, may be incorporated onto a single integrated circuit chip, such as the MC14466, MC14467-1 or the MC14468, all made by Motorola. The alarm device 300 is shown illustratively as using the MC14468 integrated smoke detector chip 310, which is described more fully in the Motorola Advance Information sheet on pages 8–13–8–17, that document incorporated by reference herein. The smoke detector chip 310 includes, among other things, a low battery comparator, a smoke comparator, the oscillator and timing circuitry, power on reset circuitry, the alarm logic and the horn driver. A block diagram of the MC14468 smoke detector chip is included as FIG. 9. One feature of the MC14468 chip 310 is that the low-battery trip point, which is internally set, may be altered via an external resistor connected to pin 3, if desired in connection with the embodiments of FIGS. 1, 2 and 4.

Figure 9:
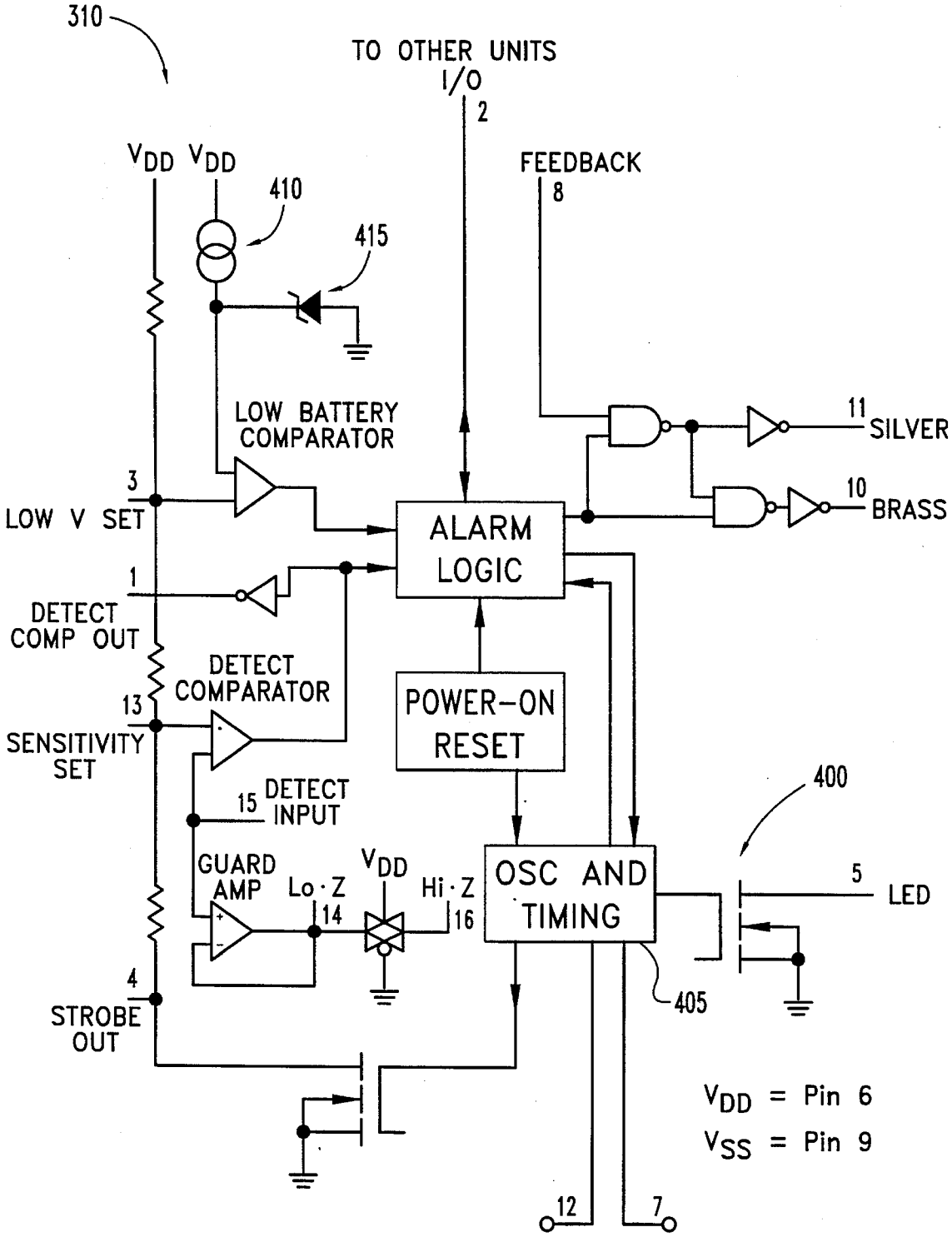
FIG. 9 is a block diagram of the smoke alarm circuitry embodied on a single integrated circuit which may be used with various embodiments of the present invention.

Referring now specifically to both FIGS. 3 and 9, the operation of the smoke alarm unit of the present invention is gown in the smoke detector art and can be similar to that disclosed in U.S. Pat. No. 4,827,244, previously incorporated by reference herein. In normal operation, in the presence of combustion products the impedance of an active ionization chamber 380, located within the smoke detection circuitry will increase. When the voltage at the electrode 382 is changed to be below a preset level, an output will be produced from a smoke comparator (FIG. 9), which is part of the smoke detection circuitry 10*c*, which will result in the alarm logic activating the horn driver (FIG. 9). The associated horn 315 will remain activated as long as the amount of combustion products is sufficient to maintain the voltage at the electrode at or above the reference.

Typically, an external test switch 340 is part of most existing smoke alarm devices. The test switch-may be actuated to manually test the operation of the smoke alarm device 300. When the external test switch 340 is closed (or radiant energy impinges on a phototransistor as taught in the '244 patent) a 1 MΩ resistor 341 is placed in parallel with the combination of electrodes 381, 382 and 383 of sensor 380 and a voltage divider is created using resistors 341 and 342. This operates to lower the voltage at the electrode 381, resulting in a predetermined change of the voltage at the electrode 382 in the same manner as it would be changed by the presence of actual combustion products in an amount sufficient to actuate the alarm. Accordingly, the actuation of the test switch 340 acts to simulate the presence of combustion products, setting the voltage of the electrode 382 so as to produce an output from the smoke comparator, as is further described in U.S. Pat. Nos. 4,827,244 and 4,097,850, previously incorporated herein.

Likewise, the low battery detection circuitry is additionally known in the smoke detector art, see U.S. Pat. No. 4,827,244, previously incorporated by reference herein. When the voltage level of the power source drops below a reference level, an output will be produced from the low voltage detection comparator located within the low voltage detection circuitry, which will cause alarm logic to activate the horn driver. So long as the voltage detected by the low voltage detection circuitry 10*a* is below the reference level, the alarm logic circuitry will periodically activate the horn driver, which will cause a horn output or 'chirp' to be produced. In the preferred embodiments of the present invention, the reference voltage level is between 7.2–7.8 volts for a primary power source having 9 DC Volts, although the reference voltage level can be adjusted by adding additional resisters to the circuit.

The smoke detection unit of the alarm device 300 shown in FIG. 3 is shown being configured in the typical smoke detecter configuration recommended in the Motorola advance sheet, previously incorporated herein. The timing constant of the oscillator and timing circuitry is set using resistor 311 and capacitor 312. In the preferred embodiment of the present invention the period of the internal oscillator is designed to be 1.67 seconds under no-smoke conditions, and 40 milliseconds under smoke conditions. As such, in the present invention it is recommended that timing capacitor 312 be 0.1 microfarads and resistor 311 have a value of 8.2 MΩ. Additionally, resistor 311 is connected to the voltage source in order to supply power to the oscillator timer and alarm circuitry. A piezo electric horn 315 is connected to the internal horn driver circuit of the smoke detector chip 310 via pins 8, 10 and 11, as shown.

Chip 310 also includes an internal n-channel enhancement mode MOSFET 400 (see FIG. 9), the drain of which is typically connected in series with an external resistor 313 and LED 314, via pin 5. Periodically, the internal oscillator and timing circuitry 405 will strobe, providing a signal at the gate of the internal MOSFET 400, thus turning that MOSFET 400 on, creating a channel from the drain to the source. As a result, a path to ground will be created through LED 314 and resistor 313. LED 314 and resistor 313 are chosen so that when the internal MOSFET 400 is conducting, a 10 milliamp lead is applied to the power source. In the present embodiment, the resistor 313 is chosen to be 330 Ω.

Additionally, the internal low voltage comparator circuit is presently as is known in the art and described more fully in the references incorporated herein. The low voltage comparator includes a reference input terminal which is connected to an internal reference voltage provided by a current source 410 connected to the effective power source for the alarm device. The reference voltage is regulated by an internal zener diode 415.

Every 24 clock cycles a check is made for a low voltage by comparing the voltage from the voltage source to the internal reference voltage, set by the internal zener diode 415. Information from the low battery comparator is latched into the low battery latch. Thus, if the output of the low battery comparator indicates that the voltage at voltage node A is below the reference voltage level, the state of the low battery latch will change, indicating that a low power source warning 'chirp' should be given.

Every 40–48 seconds, the oscillator and timing circuitry will cause the internal MOSFET 400 to turn on for about 10–12 milliseconds, thus drawing a 10 milliamp load from the effective voltage source and causing LED 314 to be pulsed. During this time the output from the low battery comparator will be reported to the low battery latch. If the low battery latch indicates that the voltage from the voltage source is low, the horn driver will activate the horn 315 for a period of 10–12 milliseconds. This results in a low battery warning 'chirp' alerting the consumer as to a problem with the detector. The periodic warning 'chirp' creates a feeling of lesser urgency than that of the continuously sounding horn warning attributable to the detection of smoke and serves as a reminder to test the detector and/or to replace power source. Thus a consumer can easily distinguish between the low battery warning and the smoke detection warning.

Additionally, as shown in FIG. 3, a divide-by-n chip 320 has been provided, the clock terminal of which is connected to pin 4 of the chip 310, so that when the internal MOSFET connected to pin 4 is pulsed, once every 40–48 seconds in the preferred embodiment, the divide-by-n chip 320 will detect the receipt of a clock pulse edge. When the number of clock pulses received by the divide-by-n chip equals the number n, an output pulse will be produced at the output terminal 323.

The output terminal 323 is connected to the set input of a flip-flop, or latch 330. Additionally, a reset circuit 370, including a comparator, the output of which is connected to the reset line of the latch 330, may be used to reset the state of the latch when the test switch 340 is manually actuated. Additionally, the output of the reset circuit may optionally be connected to the reset line of the divide-by-n counter circuitry 320. When power is first introduced to the alarm device 300, or when the test switch 340 is actuated, the reset circuitry 370 sends a pulse to the latch 330 to reset the output to low. Thus, initially, the output of the latch 330 is low. When an output signal is received at the latch 330 from the divide-by-n counter circuitry 320, the state of the latch changes, and the latch output goes high. The latch output may again be reset to low by actuating the alarm device test switch 340.

The output of the latch 330 is connected to the base of a pnp transistor 360. The emitter of the pnp transistor 360 is connected to the voltage source 350. Connected between the emitter and the collector of the transistor 360 are three serially connected diodes, 362, 363 and 364 respectively. Thus, when the base of the transistor 360 is low, and the transistor is conducting, the voltage at voltage node A is substantially the voltage of the voltage source 350. When the base of the transistor is high, and the transistor 360 is turned Off, the voltage at voltage node A is the voltage of the voltage source 350 less the voltage drop due to the serially connected diodes 362, 363 and 364. Reset circuitry 370; divide-by-n device 320 and latch 330 all receive power from the battery 350.

Thus, the alarm device 300 of FIG. 3 operates as follows. About every 40 seconds, the internal MOSFET (400 of FIG. 9) of the smoke alarm chip 310 is strobed on. At that time a clock signal edge is received by the divide-by-n device 320. When n clock pulses have been counted by the divide-by-n device 320, an output signal is sent to the latch 330, which changes state from low to high. The latch 320 stays high until it is reset via the reset line.

Prior to the latch output being high, the transistor 360 is conducting and substantially the full voltage of the voltage source 350 is present at voltage node A. When the latch output goes high, the transistor switch is turned off, and a voltage appears at voltage node A which is the voltage of the source 350, less the voltage drop due to the diodes 362, 363 and 364. Additionally, an optional LED 335 has been provided to show the state of the latch. LED 335 may be omitted or may be replaced by an incandescent bulb, so as to provide a visual indicator to remind a consumer that the time has come to manually test the detector.

When the output of the latch is high, and the voltage at the voltage node A is correspondingly reduced, a low voltage detection is made by the low battery comparator of smoke detector chip 310. Thus the low voltage latch is latched and the alarm logic causes to be produced a 10 ms 'chirp' of the smoke detector horn 315.

As described herein, the divide-by-n counter circuit 320 and the latch 330 may both be reset upon actuation of the test switch 340, using the reset circuitry 370. The actuation of the test switch 340 will test the smoke detection circuitry as described in, among others, U.S. Pat. Nos. 4,097,850 and 4,827,244, previously incorporated by reference herein. If after actuating tile test switch, the smoke alarm horn 315 does not sound, the consumer is alerted to replace the smoke alarm.

Further, the divide-by-n counter circuit 320 and the latch 330 will both be automatically reset by the reset circuitry 370 when an amount of smoke sufficient to cause the smoke detection circuitry to trigger an alarm condition is detected. As such, in embodiments including voltage drop circuitry, as described herein, the full voltage of the battery or power source is supplied to the smoke alarm circuitry when a smoke condition is reported. Thus, in the embodiment of FIG. 3, when an amount of smoke is present which is sufficient to reduce the voltage at the electrode 381 by a predetermined amount, the voltage drop circuitry will be switched out of the circuit, as would occur upon actuation of the test switch, and substantially the full voltage of battery 350 will be present at voltage node A.

Referring now to FIG. 4, there is shown an additional preferred embodiment of the alarm device 100' of the present invention, which is virtually identical to that described in FIG. 1, with the exception that alarm device 100' utilizes timing circuitry 40' independent of any timing signals generated by the smoke alarm unit 10. Otherwise, all other portions of the circuitry function identically to those described in FIG. 1, and thus have the same reference numbers as shown in FIG. 1. As such a discussion of the operation of those elements will not be repeated in connection with FIG. 4.

However, as stated above, the alarm device 100' includes the timing circuitry 40'. Timing circuitry 40' may independently generate timing signals in an analog fashion, as done by the oscillator of the oscillator timer and alarm circuitry **10*b*. Further, other timing circuits may be used, such as an a stable multivibrator, a circuit using a 555** timer chip, or some other clock device or any combination of the above.

Alternatively, the timing circuitry 40' can include digital timing circuitry similar to that of a digital wristwatch or other timer. Thus, a digital timer may be preprogrammed to send a signal to the switch control 50 at a certain time on a certain day of the week or month. For example, the digital timer may be programmed to produce an output signal every Tuesday at 7:30 p.m., thus causing the reminder circuitry to be activated at the same time each week.

Figure 5:
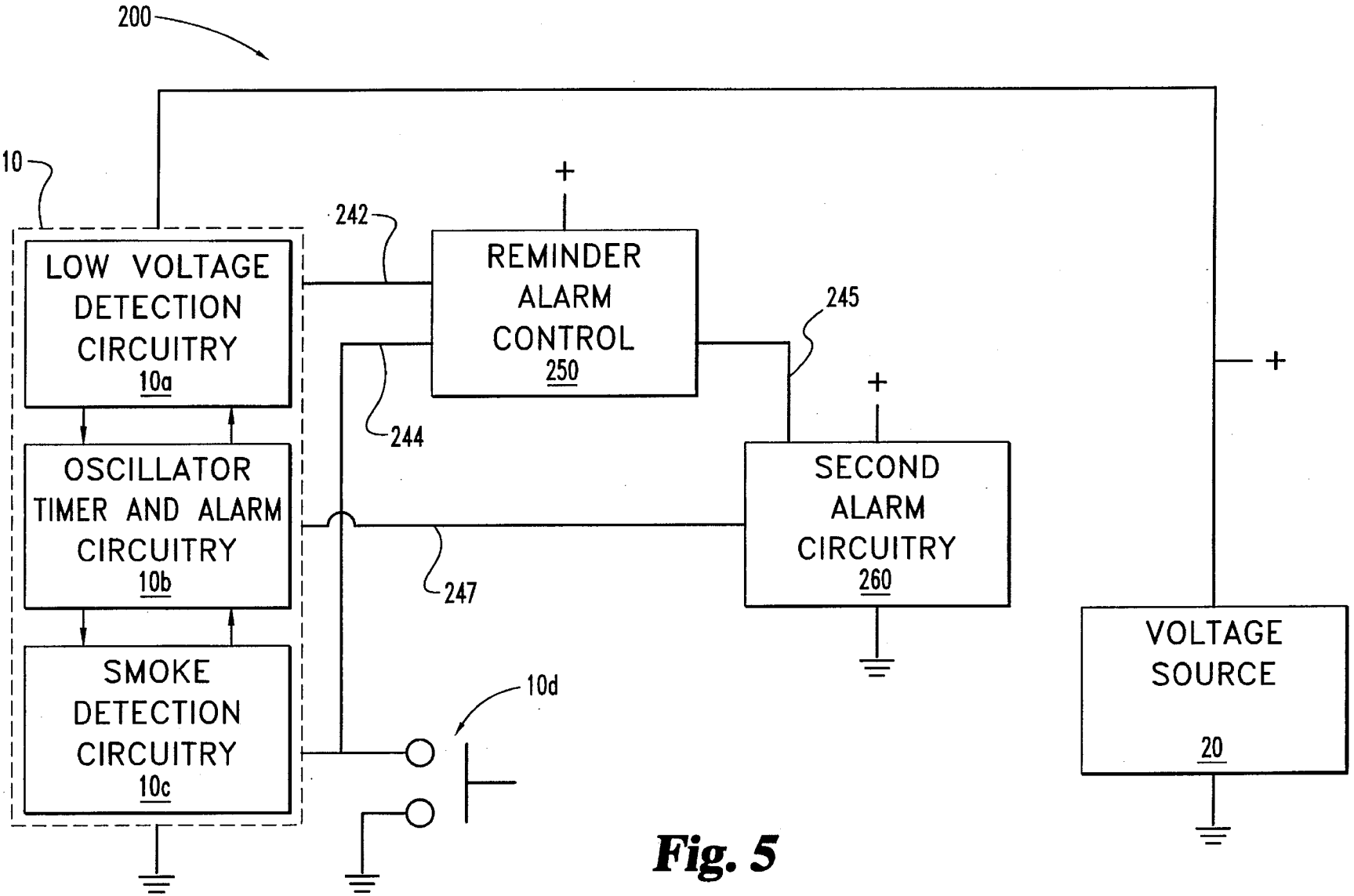
FIG. 5 is a block diagram of an additional embodiment of the present invention.

Referring now to FIG. 5, there is shown a block diagram of another embodiment of the present invention wherein, rather than using a switch, a switch control and voltage drop circuitry, a reminder alarm control 250 and second alarm circuitry 260 are used. Smoke alarm unit 10 may be the same as that described in connection with FIGS. 1–4, above. A timing signal may again be sent from the smoke alarm unit 10 to the reminder alarm control 250, via conductor 242. The reminder alarm control 250 may keep track of the number of timing pulses received and relay a signal to the second alarm circuitry 260 when the desired number of timing pulses have been received. Alternatively, the reminder alarm control 250 may include independent timing circuitry, as described in connection with the embodiment of FIG. 4.

The second alarm circuitry 260 may include a pulse or signal generator of some known type, which may be used to directly activate an indicator. In the embodiment of FIG. 5, the second alarm circuitry 260 is shown as being connected back to the smoke detection unit 10 via the conductor 247. Conductor 247 may be connected directly or indirectly across the annunciator, or horn (315 of FIG. 3), of the smoke alarm unit 10 such that the output of the second alarm circuitry 260 will cause the horn to sound when instructed to do so by the reminder alarm control 250. Additionally, the signal from the second alarm circuitry 260 may be input to the smoke alarm chip (310 of FIG. 3) via pin 2, and the alarm logic (FIG. 9) may be set to pulse the horn in a unique fashion associated only with reminding the user to test the smoke alarm.

Figure 6:
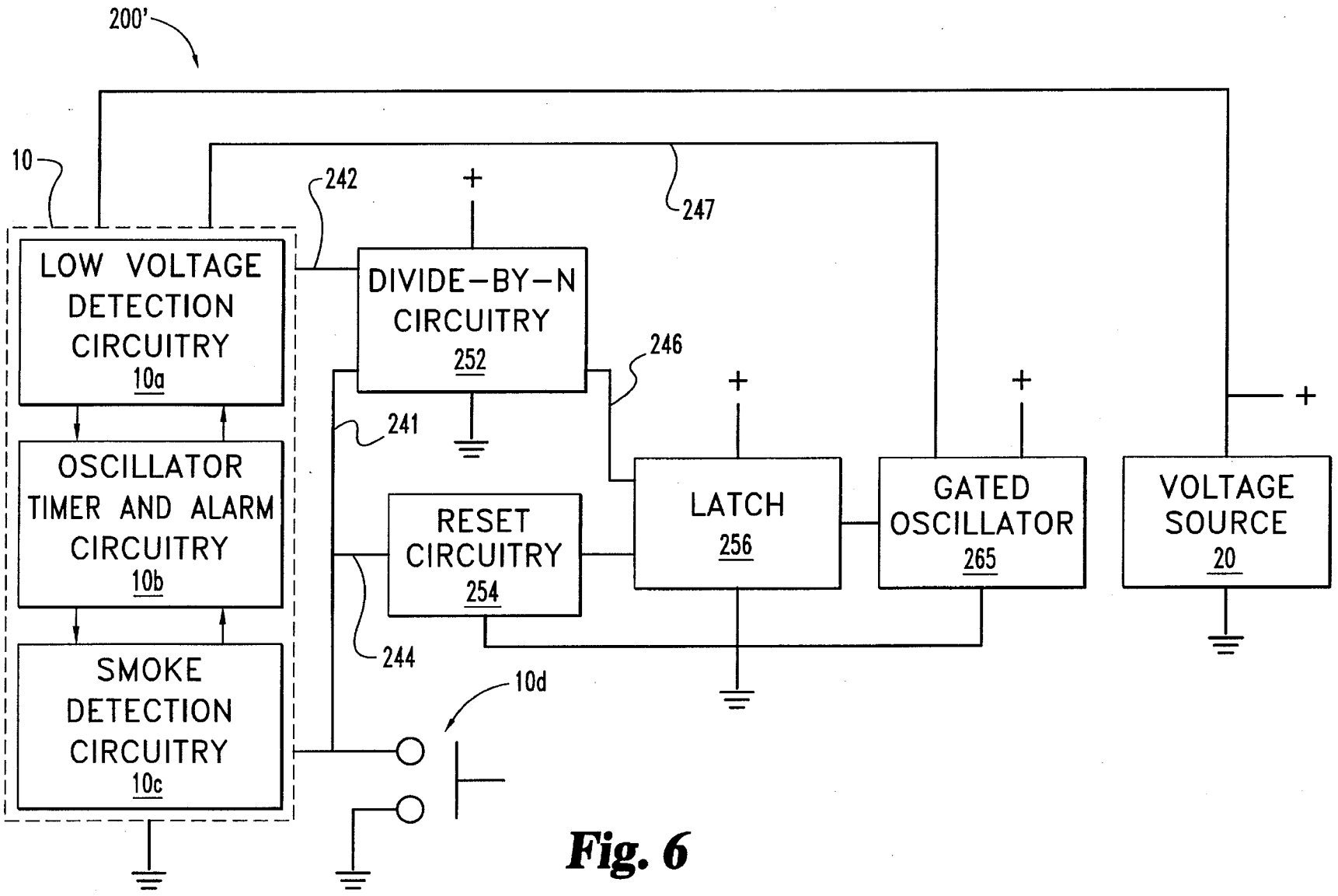
FIG. 6 is a block diagram of one particular implementation of the embodiment of FIG. 5.

In FIG. 6, there is shown one particular implementation of the embodiment of FIG. 5. In that particular implementation, the alarm device 200' includes the smoke detection unit 10 and test switch 10*d*, as in FIGS. 1–4 above. Further, divide-by-n counter circuitry 252 may receive a timing pulse from the smoke alarm unit 10, as described above. Alternatively, the divide-by-n counter circuitry may be replaced by independent timer circuitry. When n clock pulses are received, the divide-by-n counter circuitry provides an output to the latch 256 which is switched high. The latch 256 provides a continuous high output to a gated oscillator 265, which produces a periodic square wave output. One example of a gated oscillator such as may be used is described in the RADIO SHACK Engineer's Mini-Notebook Digital Logic Circuits, by Forrest M. Mims, III, copyright 1986, at page 38, that reference incorporated by reference herein. The frequency of the gated oscillator may be adjusted by changing certain gated oscillator timing elements so that the reminder alarm of the smoke detector device 200 produces an alarm which is distinct from either the low battery or smoke condition alarms, and thus may be recognized by the consumer as the reminder alarm. Further, although the use of a gated oscillator is illustrated herein, this is by no means meant to be limiting. Persons skilled in the art will recognize that other types of timed pulse or signal generating circuitry may be used as the second alarm circuitry. For example, a 555 timer circuit may be used, as may a multivibrator circuit, etc. Likewise, the reminder alarm control 250 need not comprise a divide-by-n counter and latch. Rather, other types of counters and timers may be used, as are known in the art. The remaining components shown in FIG. 6 may be as described elsewhere herein.

Referring back to FIG. 5, the reminder alarm control 250 and second alarm circuitry are both powered by the same voltage source 20, and both have ground connections. As with the above embodiments, the reminder alarm control 250 may be reset by actuation of the test switch 10*d*. In the embodiment of FIG. 6, both the latch (which is reset to low) and the divide-by-n (which is reset to zero) may be reset by actuation of the test switch 10*d*. As described above, resetting of the divide-by-n using the test switch is a convenience provided for the consumer, so that if the consumer knows that he or she will be away when the reminder circuit is triggered, then they may preemptively test the smoke alarm device and restart the reminder alarm timer circuitry. If this feature is not desired for any reason, the reset connection between the test switch and the divide-by-n counter circuitry may be omitted. Additionally as described above, if a counter is used which maintains a high output after the desired count has beer reached, the latch may be omitted.

Figure 7:
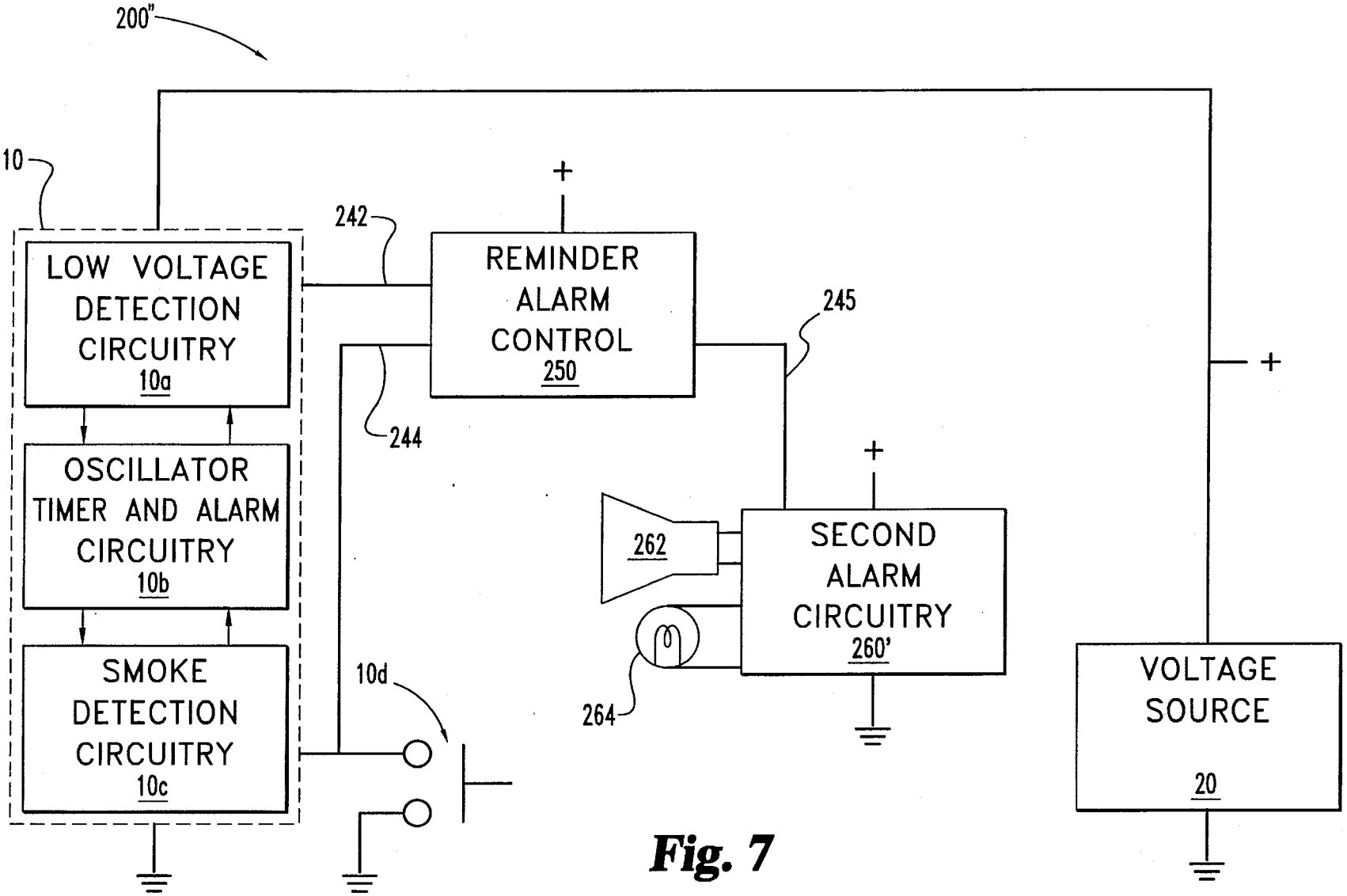
FIG. 7 is a further embodiment of the present invention.

Referring now to FIG. 7, there is shown a further alternate embodiment of the present invention. In the embodiment Of FIG. 7, a reminder alarm horn 262 and a visual indicator 264 are provided in connection with the second alarm circuitry 260'. As such, the present embodiment need not use the same annunciator used by the smoke alarm unit 10, but may include independent annunciator means. Further, the visual indicator 264 is shown as being incandescent bulb, which may either be turned on by the second alarm circuitry, or may even by pulsed by the second alarm circuitry, in order to remind the consumer to test the smoke alarm device 200. The present embodiment may additionally be modified by omitting one or the other of the second alarm 262 or visual indicator 264. Otherwise, the circuitry may be the same as described in connection with FIG. 5, such that like parts have like reference numerals in the drawings.

FIGS. 8A–C show alternate forms of voltage source 20 that may be used in connection with all embodiments of the present invention. As described above, (voltage source 20 of FIGS. 1 and 4–7), may be chosen to be either a battery, as shown in FIG. 8A, as well as by example, FIGS. 2 and 3, a DC power source converted from AC power, as shown in FIG. 8B, or a DC power source resulting either from the conversion of AC power or supplied from a backup battery, as shown in FIG. 8C. The diode 26 in FIG. 8C will be reverse biased when the AC power is present, and as such, the battery 22 will be effectively switched out of the circuit while the AC power is present.

Additionally, if desired, any of the above described embodiments may be modified such that, instead of including a reset line connected between the test switch 10*d* and the switch control (50 of FIG. 1 and 50' of FIG. 4), divide-by-n and reset circuitry (140 and 145 of FIG. 2, 252 and 254 of FIG. 6), timing circuitry (40' of FIG. 4), or reminder alarm control (250 of FIG. 5, 250' of FIG. 7), a microphone may be included. Thus, when the test switch 10*d* is actuated, the reminder circuitry of each respective embodiment is not reset until the microphone detects that the horn has sounded, thus ensuring that the alarm device has been adequately tested. The use of a microphone is not meant to be limiting as other types of sensors and detectors which would detect the output and/or vibration of the horn, such as a piezoelectric element or a pressure sensor, may be used.

Further, the present invention, may be used in connection with a missing power source indicator such as is described in Applicants' co-pending U.S. patent application Ser. No. 08/095,289, that application incorporated by reference herein.

The above circuitry described in Connection with FIGS. 1–7 may commonly be housed within a single smoke alarm housing unit which may be mounted to a ceiling or wall of a business or dwelling. Such circuitry, as has been described above, is designed to give a reminder warning to remind a consumer when to test a smoke alarm device and to reset the reminder upon manually testing the device.

While the invention has been illustrated and described in detail in the drawings and foregoing description, the same is to be considered as illustrative and not restrictive in character. For example it is in no way intended by the inventors that the invention be restricted only to specific embodiments, such as shown in the figures. Rather, it being understood that only certain preferred embodiments have been shown and described and that all changes and modifications that come within the spirit of the invention are desired to be protected.

What is claimed is:

1. A smoke alarm device, comprising:

smoke alarm circuitry;

a test switch connected to said smoke alarm circuitry for actuation by a user for testing said smoke alarm circuitry;

a reminder indicator;

a reminder circuit connected to said test switch for turning on said reminder indicator to remind said user to test said smoke alarm circuitry, wherein said reminder indicator once activated, said reminder indicator remains enabled for a prolonged period of time unless acted upon by said user.

2. The smoke alarm device of claim 1, wherein said reminder indicator and said test switch are part of said smoke alarm circuitry.

3. The smoke alarm device of claim 2, wherein said reminder indicator includes at least an audible alarm.

4. The smoke alarm device of claim 1, wherein said smoke alarm circuitry includes a power source, said power source being used to supply power to said smoke alarm circuitry, said reminder indicator and said reminder circuit.

5. The smoke alarm device of claim 4, wherein said power source is a battery.

6. The smoke alarm device of claim 4, wherein said power source includes a source of AC power.

7. The smoke alarm device of claim 5, wherein said smoke alarm circuitry additionally includes smoke chamber circuitry useful for detecting smoke, low battery circuitry for providing a low battery indication when the voltage provided by said battery is below a predetermined level land an annunciator for providing a first audible alarm when smoke is detected and for providing a second audible alarm when said low battery indication is present.

8. The smoke alarm device of claim 7, wherein said reminder circuit turns on said reminder indicator after a predetermined time interval, and wherein actuation of said test switch resets said time interval.

9. The smoke alarm device of claim 8, wherein said reminder indicator includes said annunciator, and wherein after said predetermined time interval said reminder circuit causes said annunciator to provide an audible reminder alarm.

10. The smoke alarm device of claim 8, wherein said audible reminder alarm is same as said second audible alarm.

11. A smoke alarm device, comprising:

smoke alarm circuitry including, a power source;

smoke detection circuitry connected to said power source, said smoke detection circuitry including a test switch, actuation of which said test switch by a user simulates the presence of smoke detected by said smoke detection circuitry for the purpose of testing said smoke alarm circuitry;

low voltage detection circuitry connected to said power source for detecting when a voltage provided by said power source is below a predetermined level;

oscillator timer and alarm circuitry connected to said smoke detection circuitry, to said low voltage detection circuitry and to said power source;

a reminder indicator; and a reminder circuit for turning on said reminder indicator to remind said user to test said smoke alarm circuitry, wherein said reminder indicator once activated, said reminder indicator remains enabled for a prolonged period of time unless acted upon by said user.

12. The smoke alarm device of claim 11, wherein said reminder circuit turns on said reminder indicator after a predetermined time interval.

13. The smoke alarm device of claim 12 wherein said oscillator timer and alarm circuit periodically provides a timing signal to said reminder circuit, said timing signal being used by said reminder circuit to determine when said predetermined time interval has passed.

14. The smoke alarm device of claim 13, wherein said reminder circuit includes a counter for counting clock pulses from the oscillator timer circuit.

15. The smoke alarm device if claim 13, wherein said counter is a divide-by-n counter.

16. The smoke alarm circuitry of claim 13 wherein said reminder circuit additionally includes:

a first circuit path connected between said power source and at least said low voltage detection circuitry;

a second circuit path, connected in parallel with said first circuit path;

voltage drop circuitry connected in series with said second circuit path and in parallel with said first circuit path; and a two-state switch connected in series with said power source, wherein when said switch is a first state current flows through said first circuit path, and wherein when said switch is in a second state current flows through said second current path and through said voltage drop circuitry.

17. The smoke alarm circuitry of claim 16, wherein said two-state switch is a resistor switch.

18. The smoke alarm circuitry of claim 17, wherein said voltage drop circuitry includes at least one diode.

19. The smoke alarm circuitry of claim 17, wherein said voltage drop circuitry includes at least three diodes.

20. A smoke alarm device, comprising:

smoke alarm circuitry including, a power source;

smoke detection circuitry connected to said power source;

oscillator timer and alarm circuitry connected to said smoke detection circuitry and to said power source;

an indicator to remind said user to test said smoke alarm circuitry;

a reminder circuit for enabling said indicator;

a test switch, connected to said smoke detection circuitry and said reminder circuit;

wherein said reminder indicator once activated, said reminder indicator remains enabled for a prolonged period of time unless acted upon by said user; and wherein actuation of said test switch resets said reminder circuit, turning said indicator off, and causes said smoke detection circuitry to be tested.

21. The smoke alarm device of claim 11, wherein said reminder circuit is connected to said smoke alarm circuitry to receive a train of clock pulses from said smoke alarm circuitry, wherein said reminder circuit includes a counter for counting the number of clock pulses received from said smoke alarm circuitry.

22. The smoke alarm device of claim 21 wherein said reminder circuit enables said indicator when a predetermined number of clock pulses have been counted.

23. The smoke alarm device if claim 22, wherein said counter is a divide-by-n counter.

24. The smoke alarm circuitry of claim 22, wherein said reminder circuitry additionally includes low voltage detection circuitry connected to said power source for detecting when a voltage provided by said power source is below a predetermined level and wherein said reminder circuit additionally includes:

a first circuit path connected between said power source and at least said low voltage detection circuitry;

a second circuit path, connected in parallel with said first circuit path;

voltage drop circuitry connected in series with said second circuit path and in parallel with said first circuit path; and a two-state switch connected in series with said power source, wherein when said switch is in a first state current flows through said first circuit path, and wherein when said switch is in a second state current flows through said second current path and through said voltage drop circuitry.

25. The smoke alarm circuitry of claim 24, wherein said two-state switch is a transistor switch.

26. The smoke alarm circuitry of claim 25, wherein said voltage drop circuitry includes at least one diode.

27. A smoke alarm device, comprising:

smoke alarm circuitry including, a power source;

smoke detection circuitry connected to said power source;

low voltage detection circuitry connected to said power source for detecting when a voltage provided by said power source is below a predetermined level;

oscillator timer and alarm circuitry connected to said smoke detection circuitry and to said power source;

an indicator, connected to said smoke alarm circuitry, for indicating when said low voltage detection circuitry detects a low voltage;

a reminder circuit for purposely causing a voltage below said predetermined level to be delivered to at least said low voltage detection circuitry in order to enable said indicator, said reminder circuit including:

a pnp-type transistor switch including an emitter terminal, a base terminal and a collector terminal, said emitter terminal being connected to said power source;

voltage drop circuitry including at least one diode connected in series between said emitter terminal and said collector terminal of said transistor switch for reducing the voltage of said power source below said predetermined level;

a switch control having an input terminal connected to said smoke alarm circuitry and an output terminal connected to the base terminal of said transistor switch, said switch control including a counter for counting clock pulses received from said smoke alarm circuitry, said switch control producing an output when a predetermined number of clock pulses have been received by said counter;

wherein said output from said switch control is used to turn said transistor switch off;

a test switch, connected to said smoke detection circuitry and said reminder circuit; and wherein actuation of said test switch resets said reminder circuit and causes said smoke detection circuitry to be tested.

28. A smoke alarm device, comprising:

smoke alarm circuitry;

a test switch connected to said smoke alarm circuitry for actuation by a user for testing said smoke alarm circuitry;

a reminder indicator including an audible alarm;

a reminder circuit connected to said test switch for enabling said reminder indicator to remind said user to test said smoke alarm circuitry, wherein actuation of said test switch will reset said reminder circuit; and wherein once said reminder indicator is activated, said reminder indicator remains enabled until manually reset.

29. The smoke alarm device of claim 28 wherein said audible alarm is additionally connected to said smoke alarm circuitry to indicate the detection of smoke by said smoke alarm circuitry.

30. A method for reminding a user to test a smoke alarm including the steps of:

providing a smoke alarms including:

smoke alarm circuitry;

a test switch connected to said smoke alarm circuitry for actuation by a user for testing said smoke alarm circuitry;

a reminder indicator;

a reminder circuit connected to said test switch for enabling said reminder indicator to remind said user to test said smoke alarm circuitry, wherein actuation of said test switch will reset said reminder circuit; and wherein once said reminder indicator is activated, said reminder indicator remains enabled until manually reset; and actuating said test switch to reset said reminder indicator.

31. The method of claim 30, wherein said providing step includes providing a smoke alarm wherein said reminder circuit turns on said reminder indicator after a preset time interval.

* * * * *